US005346559A

United States Patent [19]

Ushigami et al.

[11] Patent Number: 5,346,559

[45] Date of Patent: Sep. 13, 1994

[54] PROCESS FOR MANUFACTURING DOUBLE ORIENTED ELECTRICAL STEEL SHEET HAVING HIGH MAGNETIC FLUX DENSITY

[75] Inventors: Yoshiyuki Ushigami; Satoshi Arai; Yozo Suga; Yasunari Yoshitomi; Nobuyuki Takahashi; Takehide Senuma, all of Kitakyushu, Japan

[73] Assignee: Nippon Steel Corporation, Tokyo, Japan

[21] Appl. No.: 34,615

[22] Filed: Mar. 19, 1993

Related U.S. Application Data

[63] Continuation of Ser. No. 680,937, Apr. 5, 1991, abandoned.

[30] Foreign Application Priority Data

| | | | |
|---|---|---|---|
| Apr. 12, 1990 | [JP] | Japan | 2-95126 |
| Apr. 16, 1990 | [JP] | Japan | 2-97718 |
| Apr. 20, 1990 | [JP] | Japan | 2-103180 |
| Apr. 20, 1990 | [JP] | Japan | 2-103181 |

[51] Int. Cl.[5] ..... C21D 8/12

[52] U.S. Cl. ..... 148/111; 148/112

[58] Field of Search ..... 148/111, 112, 651

[56] References Cited

U.S. PATENT DOCUMENTS

| | | | |
|---|---|---|---|
| 2,046,717 | 7/1936 | Bitter | 148/111 |
| 3,130,093 | 4/1964 | Kohler | 148/111 |
| 3,130,095 | 4/1964 | Kohler et al. | 148/113 |
| 3,136,666 | 6/1964 | Taguchi et al. | 148/111 |
| 3,163,564 | 12/1964 | Taguchi et al. | 148/111 |
| 4,204,891 | 5/1980 | Shiozaki et al. | 148/111 |
| 4,406,715 | 9/1983 | Nakayama et al. | 148/111 |
| 4,437,909 | 3/1984 | Mori et al. | 148/111 |
| 4,997,493 | 3/1991 | Ushigami et al. | 148/111 |

FOREIGN PATENT DOCUMENTS

| | | | |
|---|---|---|---|
| 0206108 | 12/1986 | European Pat. Off. . | |
| 318051 | 5/1989 | European Pat. Off. | 148/111 |
| 35-2657 | 3/1960 | Japan . | |
| 35-17208 | 11/1960 | Japan . | |
| 37-7110 | 7/1962 | Japan . | |
| 38-8213 | 6/1963 | Japan . | |
| 40-15644 | 7/1965 | Japan . | |
| 51-13469 | 4/1976 | Japan . | |
| 63-72824 | 4/1988 | Japan | 148/111 |

OTHER PUBLICATIONS

K. T. Aust, J. W. Rutter: Trans. Met. Soc. AIME 215(1959) pp. 119/127.

Ushigami et al. Abstract of 96th Symposium of Metallurgy Society of Japan, p. 373, 1985.

*Primary Examiner*—George Wyszomierski

*Attorney, Agent, or Firm*—Wenderoth, Lind & Ponack

[57] ABSTRACT

The present invention provides a process for manufacturing a double oriented electrical steel sheet having a high flux density by suppressing the growth of the secondary recrystallization of {110} <uvw> oriented grains from the surface of the steel sheet in the hot-rolling stage or cold-rolling stage, which process comprises subjecting a hot rolled sheet comprised of 0.8–6.7% by weight of Si, 0.008–0.048% by weight of acid soluble Al, 0.010% by weight or less of N, and the balance being Fe and unavoidable impurities to a cold-rolling at a reduction rate of 40–80%, and then subjecting the resulting sheet to another cold-rolling in the direction vertical to the above cold-rolled direction at the reduction rate of 30–70% in the final thickness, followed by the steps of annealing for the primary recrystallization, applying an annealing separator, and applying finishing annealing for the secondary recrystallization and purification of steel, wherein the rolling in the finishing hot-rolling stage is carried out at the accumulated reduction rate of 20% or more under the condition that the friction coefficient between the rolls and the steel sheet is not more than 0.25; and wherein the accumulated reduction rate in the last three passes in the hot-rolling is not more than 80%; and further, wherein material of more than 1/10 of the total thickness is removed from both surfaces of the hot-rolled sheet; or wherein the cold-rolling is carried out using a work roll having a diameter of not less than 150 mm.

2 Claims, 9 Drawing Sheets

PROCESS FOR MANUFACTURING DOUBLE ORIENTED ELECTRICAL STEEL SHEET HAVING HIGH MAGNETIC FLUX DENSITY

This application is a continuation of now abandoned application Ser. No. 07/680,937, filed Apr. 5, 1991.

BACKGROUND OF THE INVENTION (1) Field of the Invention

This invention relates to a process for manufacturing a double oriented electrical steel sheet including recrystallized grains whose easy axis <001> of magnetization is oriented both in the longitudinal orientation and in the direction vertical thereto, together with the rolled surfaces exhibiting {100} planes (those crystallographic orientations can be represented as {100} <001> in the Miller indices).

(2) Description of the Related Art

Since the double oriented electrical steel sheet has excellent magnetic properties in two different directions, because of its easy axis (<001> axis) in the rolled direction and in the direction vertical thereto, it can be more advantageously used for a magnetic core material of a specific apparatus, e.g., a large-scale rotating machine, where the magnetic flux flows in two different directions in comparison with a grain oriented electrical steel sheet which exhibits excellent magnetic properties in only one rolled direction. Non-oriented magnetic steel sheet, whose easy axis is not densely accumulated, are generally used for a small stationary machine or installation. The use of double oriented electrical steel sheet, however makes it possible to miniaturize the machine with an increased efficienty.

The double oriented electrical steel sheet, which has excellent magnetic properties as described above, has long been expected to be put into mass production, but the general use of such a type of sheet as an industrial product is still limited at present.

The following two methods in the prior art have been proposed for manufacturing a double oriented electrical steel sheet:

A method wherein an initial steel sheet is annealed at a high temperature in an atmosphere containing a polar gas, e.g., hydrogen sulfide, to secondarily recrystallize out {100} <001> oriented grains with the aid of surface energy, as described in Japanese Examined Patent Publication No.37-7110. This method is inadequate for mass production, however, because it requires a very accurate control of the surface energy of the sheet.

An other method wherein a steel sheet is cold-rolled in one direction and then cold-rolled in a direction vertical thereto, i.e., a cross cold r olling method", as described in Japanese Examined Patent Publication No. 35-2657. The magnetic flux density ($B_8$) of the products obtained by this method is not more than 1.85 Tesla, and accordingly, a significant improvement of the magnetic properties can not be obtained in spite of the complicated manufacturing process, which in turn requires an increased cost. The double oriented electrical steel sheet obtained by this method is not preferable to the conventional grain oriented electrical steel sheet.

The magnetic flux density ($B_8$) of the grain oriented electrical steel sheet has steadily improved, since the techniques disclosed in Japanese Examined Patent Publication No.40-15644 and Japanese Examined Patent Publication No. 51-13469 were disclosed. At present, the magnetic flux density ($B_8$) of the commercially available products is as high as 1.92 T.

An improved method has been proposed to enhance the magnetic properties in a double oriented electrical steel sheet, as disclosed in Japanese Examined Patent Publication No. 35-17208 and Japanese Examined Patent Publication No. 38-8213. Nevertheless, the magnetic flux density of the resulting products has not been made higher than that of the grain oriented electrical sheet.

SUMMARY OF THE INVENTION

An object of this invention is to provide a process for stably manufacturing a double oriented electrical steel sheet having a high magnetic flux density.

Specifically, the object of this invention is to suppress the growth of {110} <uvw> oriented grains which are initiated from the surface of the steel sheet due to the secondary recrystallization, since these grains deteriorate the magnetic properties of the double oriented electrical steel sheet.

According to the present invention, the concrete means of suppression are as follows:

The present invention is intended to provide a process for manufacturing a double oriented electrical steel sheet having a high flux density by suppressing the growth of the secondary recrystallization of {110} <uvw> oriented grains from the surface of the steel sheet in the hot-rolling stage or cold-rolling stage, which process is characterized by a process which comprises subjecting a hot-rolled sheet comprised of 0.8–6.7% by weight of Si, 0.008–0.048% by weight of acid soluble Al, 0.010% or less by weight of N, and the balance being Fe and unavoidable impurities to a cold-rolling at a reduction rate of 40–80%, and then subjecting the resulting sheet to another cold-rolling in the direction vertical to the above cold-rolled direction at the reduction rate of 30–70% in the final thickness, followed by annealing for the primary recrystallization, applying an annealing separator, and applying finishing annealing for the secondary recrystallization and steel purification, wherein the rolling in the finishing hot-rolling stage is carried at the accumulated reduction rate of 20% or more under the condition that the friction coefficient between the rolls and the steel sheet is not more than 0.25; wherein the accumulated reduction rate in the last three passes in the hot-rolling is not more than 80%; wherein more than 1/10 of the total thickness of the material is removed from both surfaces of the hot-rolled sheet; or wherein the cold-rolling is carried out using a work roll having a diameter of not less than 150 mm.

DESCRIPTION OF THE PREFERRED EMBODIMENTS

The inventors studied products of double oriented . electrical steel sheet manufactured by the cross cold-rolling method, and found the following.

The crystalline orientation optimal for a double oriented electrical steel sheet is of {100} <001>. In crystalline grains after the secondary recrystallization, however, {110} <uvw> oriented grains exist together with the above-mentioned grains of {100} <001>, and the former lowers the magnetic density. Accordingly, {110} <uvw> oriented grains after the secondary recrystallization must be suppressed to obtain a high magnetic flux density.

After a further study in detail of the orientation of these grains, it was found that the sheet created by the primary recrystallization prior to the secondary recrystallization exhibited a different texture in the varied thickness of the sheet, i.e., {110} <uvw> oriented grains start to grow from the surface layer, whereas {100} <001> oriented grains grow from the central layer.

Figure 1A:
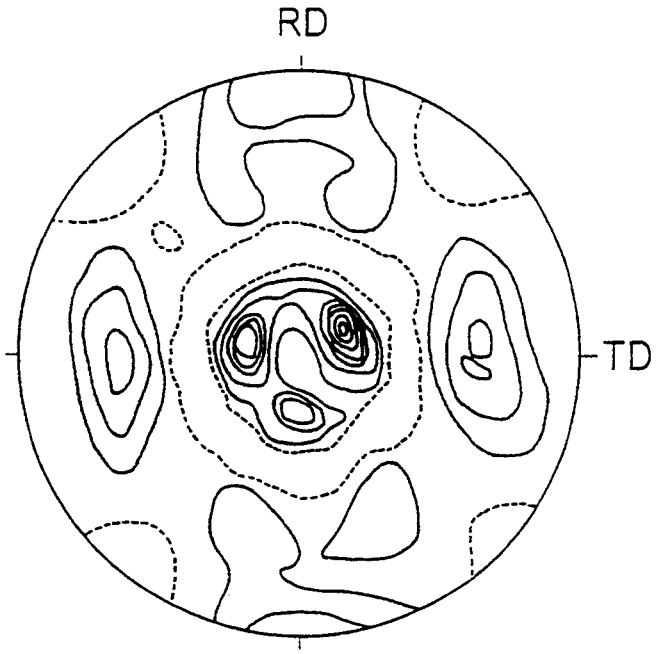
FIGS. 1(*a*) and 1(*b*) show (200) pole figures representing the texture of surface layer (a) and center layer (b) in the primary recrystallization.
Figure 1B:
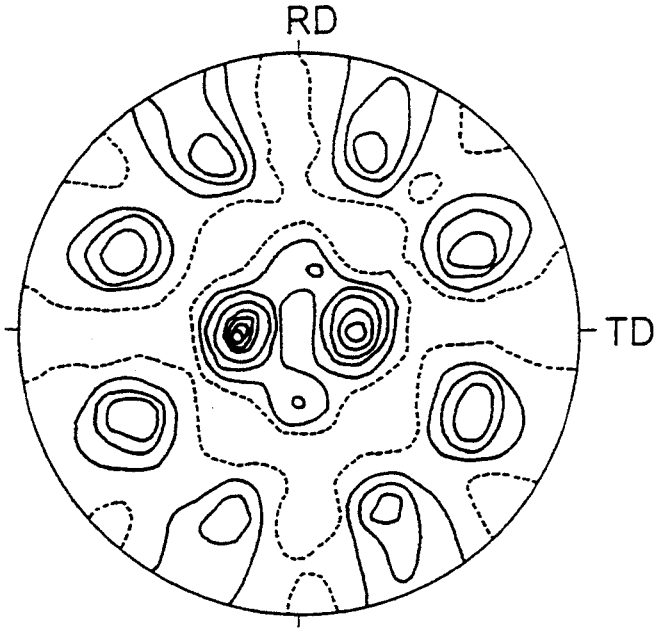
Figure 2:
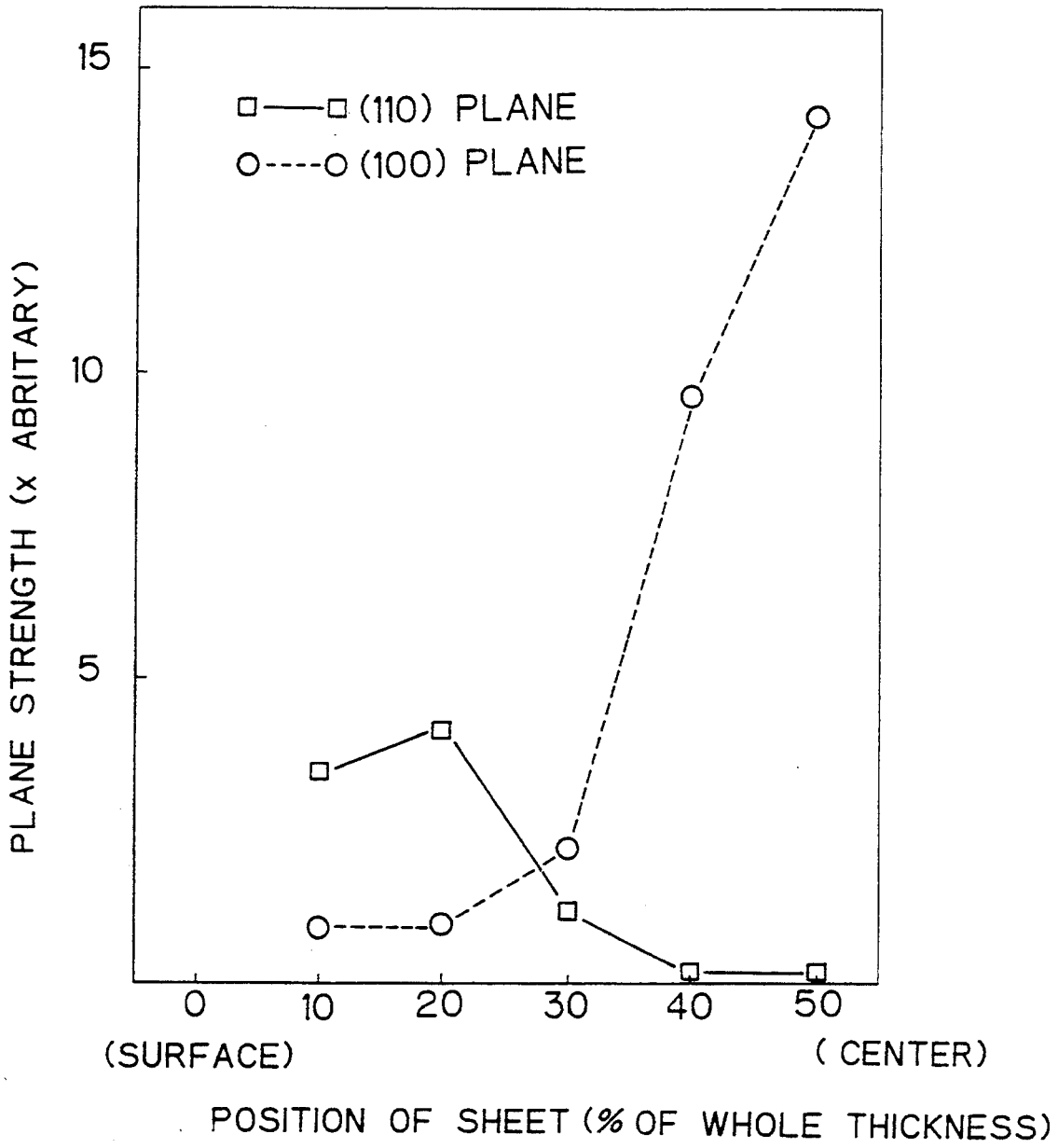
FIG. 2 shows the texture at various depths of the hot-rolled sheet.

This has been confirmed by the following experiments: A hot-rolled 1.8 mm thickness sheet comprised of 0.055% of C, 3.3% of Si, 0.028% of acid soluble Al, 0.007% of N, and the balance being Fe and unavoidable impurities was annealed at 1125° C. for 2 minutes, and then cold-rolled at a reduction rate of 55% in the same direction as in the hot-rolled direction, and further, cold cross-rolled at a reduction rate of 55% in the direction vertical to the above rolled direction to form a sheet having a final thickness of 0.35 mm. The sheet thus cold rolled was annealed for the primary recrystallization at 810° C. for 210 seconds in a wet hydrogen atmosphere; this heat treatment also served for a decarburization of the sheet. An examination of the texture in the sheet thus recrystallized showed that the main orientations of the grains were {110} <001> and {111} <uvw> in the vicinity of the surface shown in FIG. 1(*a*), whereas they were was {211} <124> and {211} <231> at the central portions, as shown in FIG. 1(*b*). This implies that the crystalline orientation of major grains varies from sheet depth to sheet depth. It should be noted that the recrystalline orientation of grains in the secondary recrystallization is strongly influenced by the texture in the primary recrystallization as reported, for instance, by K. T. Aust, J. W. Rutter in Trans. Met. Soc. AIME, 215 (1959), pp. 119–127., and by Ushigami et al. in Abstract of 96th Symposium of Metallurgy Society of Japan, pp. 375. The dependence of the texture on the depth of the sheet treated by the primary recrystallization was further studied, and as shown in FIG. 2, it is found that the dependence is largely influenced by the inclination of the texture versus the depth of the hot-rolled sheet. To determine this, test pieces were selectively prepared by cutting same from the hot-rolled sheet at the surface and central portions, respectively. These pieces were primarily recrystallized under the same conditions of the primary recrystallization as mentioned above, and then annealed in the finishing stage after an annealing separator containing MgO as a main component was applied.

Figure 3A:
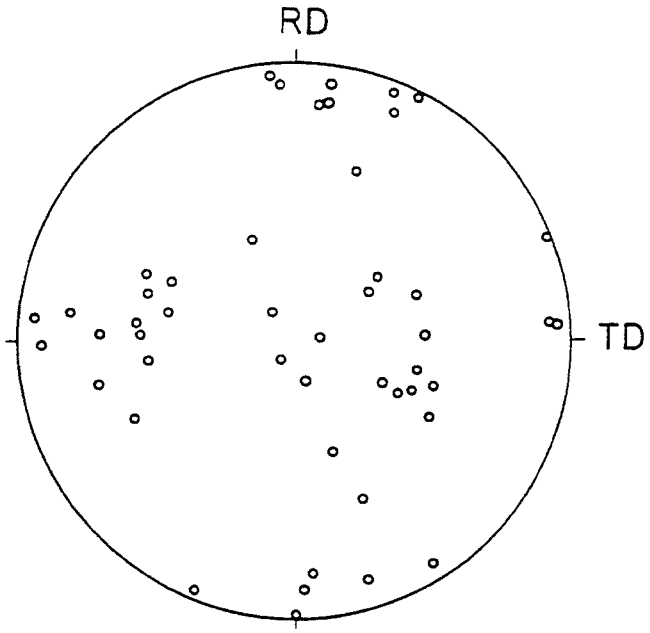
FIGS. 3(*a*) and 3(*b*) show (200) pole figures showing the orientation distribution of secondary recrystallized grain with the starting material of the surface layer of the hot-rolled sheet (a) and the center layer of the hot rolled sheet (b)
Figure 3B:
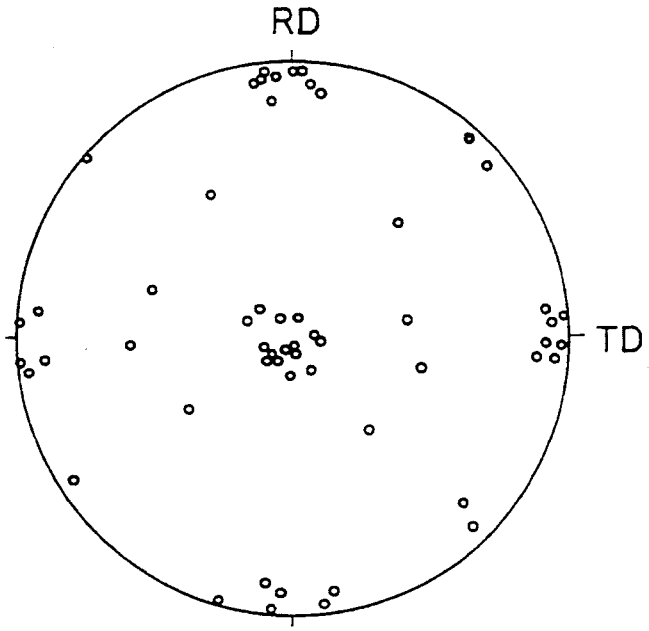

FIG. 3 shows the orientation distribution of the secondary recrystallized grains of the respective test pieces thus prepared. From FIG. 3, it can be seen that grains having {110} <uvw> orientations grow from the surface of the hot-rolled sheet, whereas grains having {100} <001> orientations grow from the central area.

Therefore, it is considered that {110} <uvw> oriented grains resulting in a decreased magnetic flux density may be successfully suppressed by reducing the {110} texture in the hot-rolled sheet during the course of the primary recrystallization.

On the basis of the above finding, a further study was made of the conditions of hot- and cold-rolling in detail, and the following means for suppressing such an undesirable texture determined:

(1) By setting the friction coefficient between a steel sheet and hot-rolling rolls in an amount of less than 0.25, {110} <uvw> oriented grains grown from the surface areas are suppressed in the secondary recrystallization due to the change of the texture in the hot-rolled sheet, thereby ensuring the stable manufacture of a double oriented electrical steel sheet having a high magnetic flux density.

The experimental results obtained are now described. A slab containing the same components as mentioned above was hot-rolled with a varied friction coefficient, and then annealed at 1050° C. for 2 minutes. Thereafter, the sheet thus rolled was cold-rolled at a reduction rate of 50% in the same direction as the hot-rolled direction, and further cold cross-rolled at a reduction rate of 50% in the direction vertical to the above-mentioned direction. Moreover, the sheet was annealed for both the primary recrystallization and decarburization at 800° C. for 90 seconds in a wet hydrogen atmosphere, and further annealed for finishing after applying an annealing separator.

Figure 4:
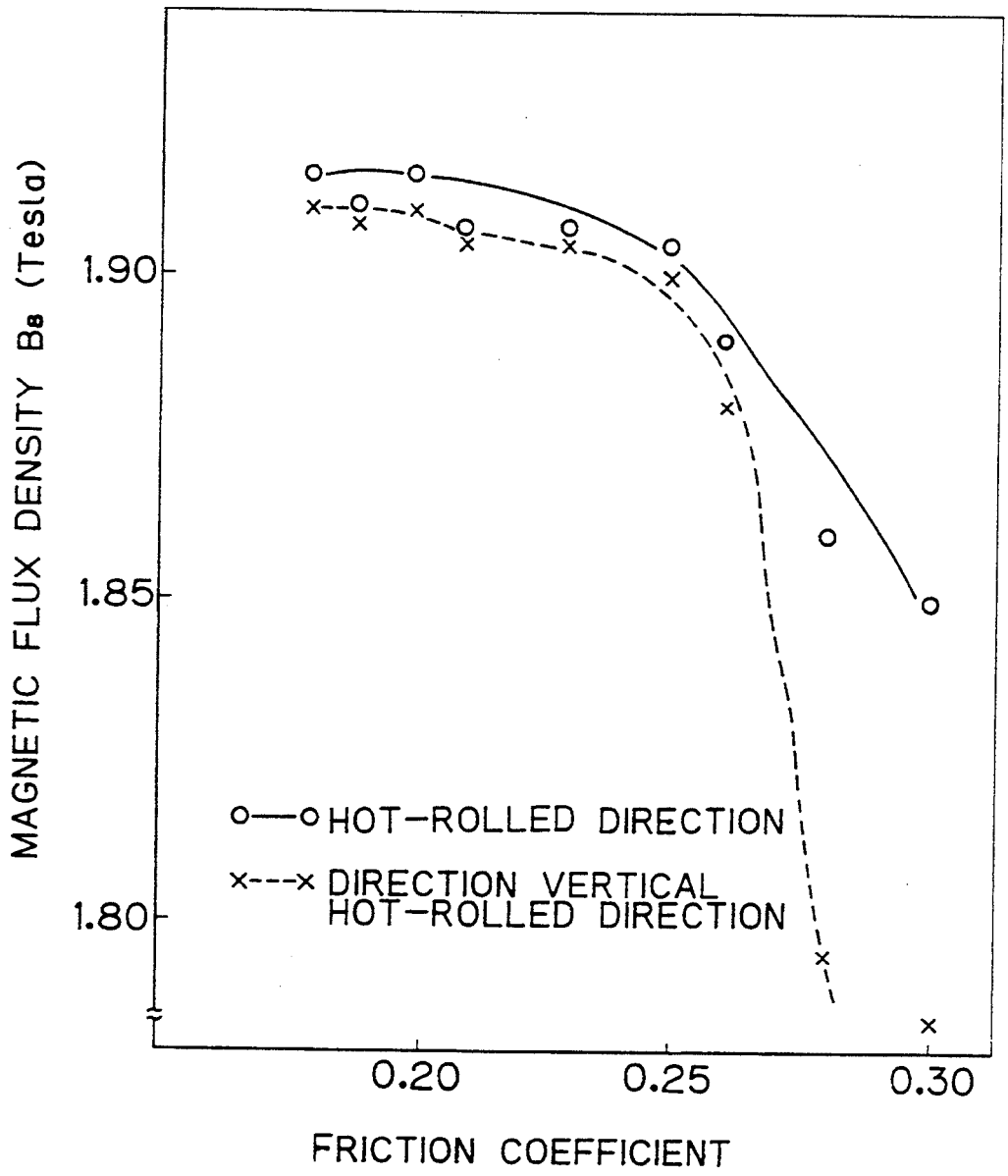
FIG. 4 shows the relationship between the magnetic flux density ($B_8$) of a product and the friction coefficient at the hot-rolling.

FIG. 4 shows the relationship between the friction coefficient employed and the magnetic flux density ($B_8$) of the product obtained at an accumulated reduction rate of 50% in the finishing rolling process of the hot rolling. It can be seen from FIG. 4 that a product having a high magnetic flux density of more than 1.90 Tesla can be obtained when the friction coefficient is less than 0.25.

An examination of the texture of the hot-rolled sheet obtained with a friction coefficient of less than 0.25 reveals that the grains having {110} surfaces are markedly eliminated. The results suggest that secondary recrystallization of {110} <uvw> oriented grains grown from the surface areas is suppressed.

Figure 5:
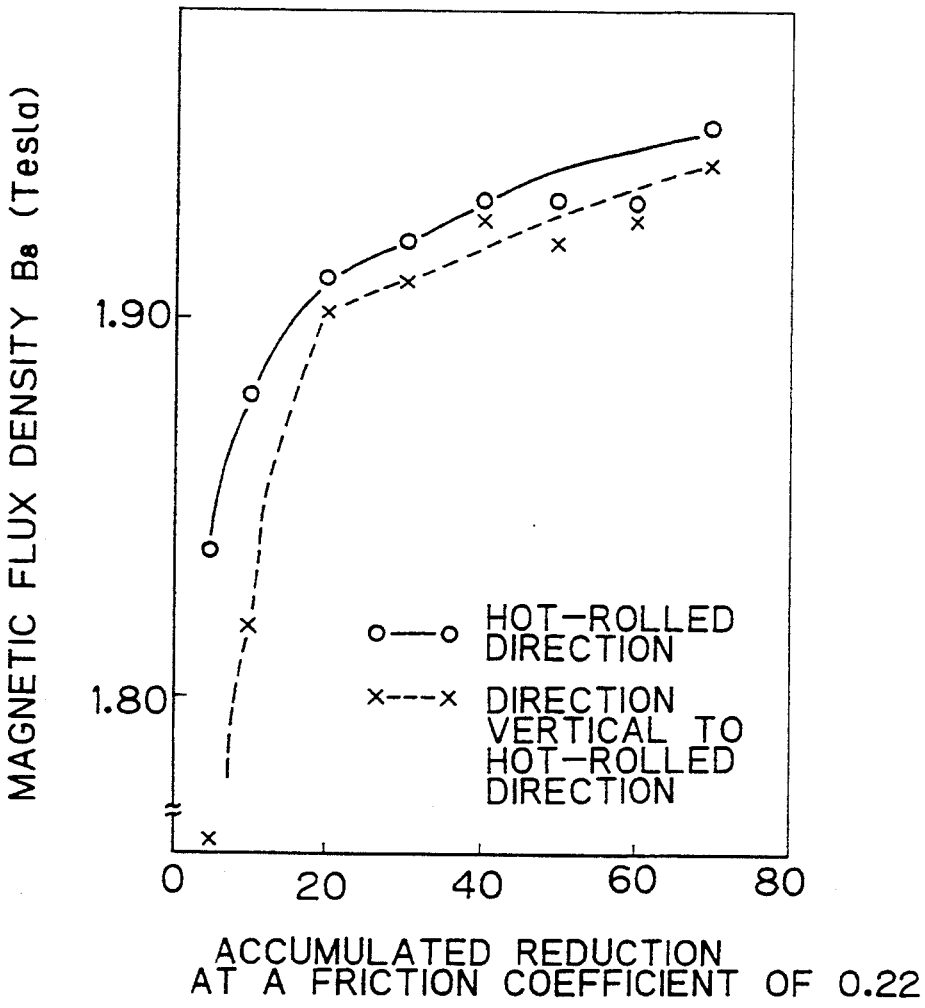
FIG. 5 shows the relationship between the magnetic flux density ($B_8$) of a product and the accumulated reduction rate at which hot-rolling of the final stage is made with a low friction coefficient.

Taking into account these results, the effect of the accumulated reduction rate in the hot-rolling was further studied under the fixed condition for a friction coefficient of 0.22 in the finishing rolling process. As shown in FIG. 5, products having a high magnetic flux density of more than 1.90 Tesla can successfully obtained when the accumulated reduction rate is not less than 20% is employed.

Since the difference in the texture obtained with varied friction coefficients is concealed due to the recrystallization, etc., in the initial stage of the hot-rolling, the coefficient may be adjusted at the final stage, i.e., the finishing rolling stage at which difference in the texture is clarified.

(2) By setting an accumulated reduction rate of less than 80% in the final three passes of the hot-rolling process, and setting a temperature of 950° C. or more for finishing hot-rolling, the growth of {110} <uvw> oriented grains from the surface is suppressed due to change of texture in the hot-rolled sheet, thereby ensuring the stable manufacture of a double oriented electrical steel sheet having a high magnetic flux density.

The experimental results obtained will be described. A 40 mm-thick slab having the same components as described previously was hot-rolled into a 2.0 mm thickness sheet, using six passes with a varied pass schedule. The temperature in the final hot-rolling was 900°–950° C. The sheet was then annealed for 2 minutes at 1050° C. Subsequently, the sheet was cold-rolled at a reduction rate of 50% in the same direction as the hot-rolled direction, and further cold cross-rolled at a reduction rate of 50% in the direction vertical to the above rolled direction. Furthermore, the sheet was annealed for the primary recrystallization and the decarbonization at 800° C. for 90 seconds in a wet hydrogen atmosphere. Finally, the sheet was annealed for finishing after applying an annealing separator.

Figure 6:
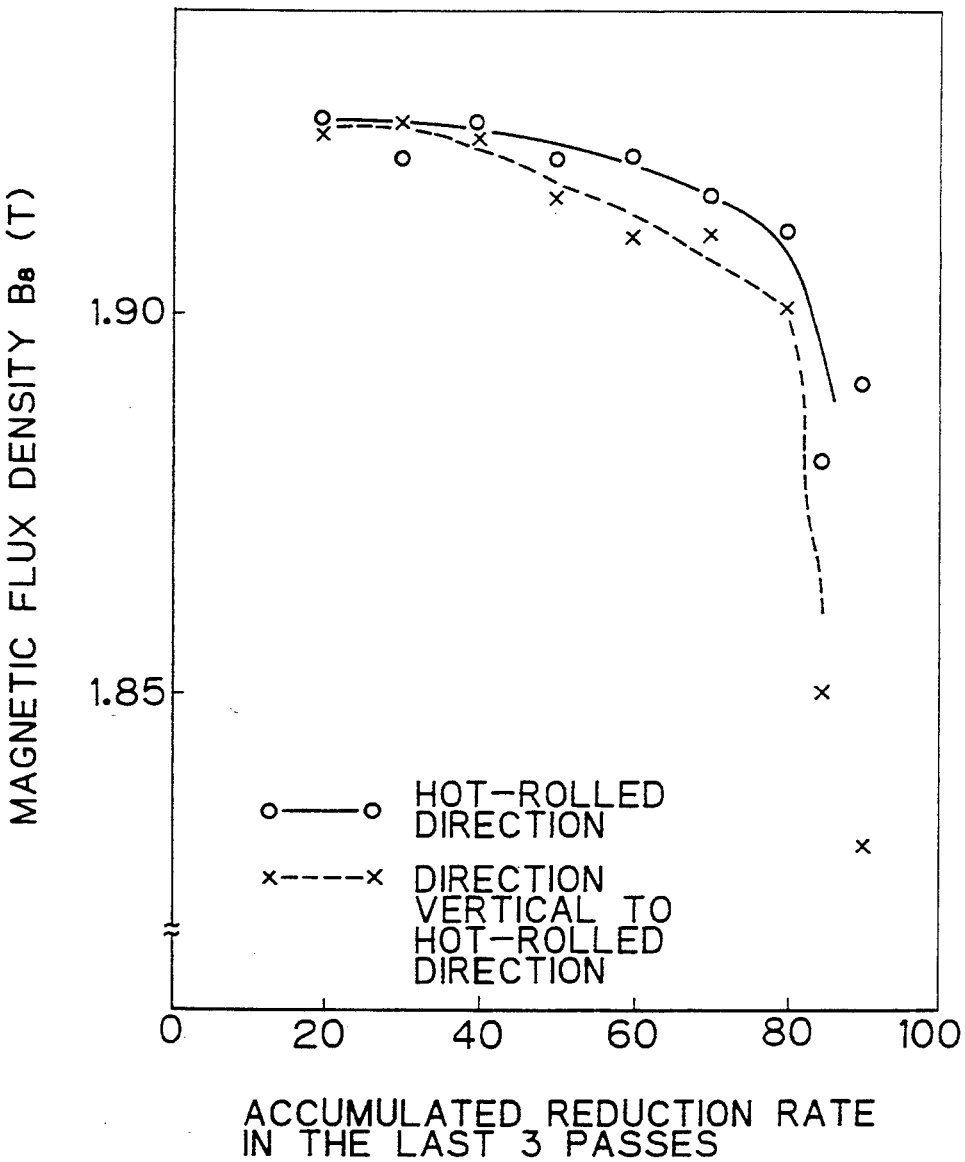
FIG. 6 shows the relationship between the magnetic flux density ($B_8$) of a product and the accumulated reduction rate at the final three passes of the hot-rolling.

FIG. 6 shows the relationship between the accumulated reduction rate in the final three passes of the hot-rolling and the magnetic property ($B_8$ value) of the product obtained. From this diagram, it can be seen that a product having a high magnetic flux density of more than 1.90 Tesla at an accumulated reduction rate of less than 80% was obtained.

On the basis of the experimental results, the effect of the final temperature in the stage of hot-rolling on the magnetic property was studied at an accumulated reduction rate of 80% in the final three passes with varied delay time, and as a result, it was found that the magnetic flux density was further increased when the temperature of the final hot-rolling was not less than 950° C.

An examination of the texture in the hot-rolled sheet reveals that a hot-rolled sheet having a high magnetic flux density always contained less {110} oriented grains in the vicinity of the surface layer. In accordance with the present invention, therefore, it can be concluded that {110} texture formed was reduced due to the recrystallization, in which case the crystal rotation due to the shear deformation at the surface is suppressed, when the accumulated reduction rate at the final three passes was kept at less than 80%, and/or the temperature of the final hot-rolling was kept at more than 950° C.

(3) By removing the surface layers at both sides of a hot-rolled sheet by a depth of 1/10–⅓ total thickness, {110} texture formed at the surface layers of a hot-rolled sheet was reduced to suppress {110} <uvw> oriented grains grown from the both surfaces in the secondary recrystallization, thereby ensuring the stable manufacture of a double oriented electrical steel sheet having a high magnetic flux density.

The experimental results obtained will be described. A slab containing the same components as described above was hot-rolled into a 1.8 mm thickness hot-rolled sheet under the same conditions. The surface layers of the 1.8 mm thick hot rolled sheet were removed by a grinder.

Figure 7:
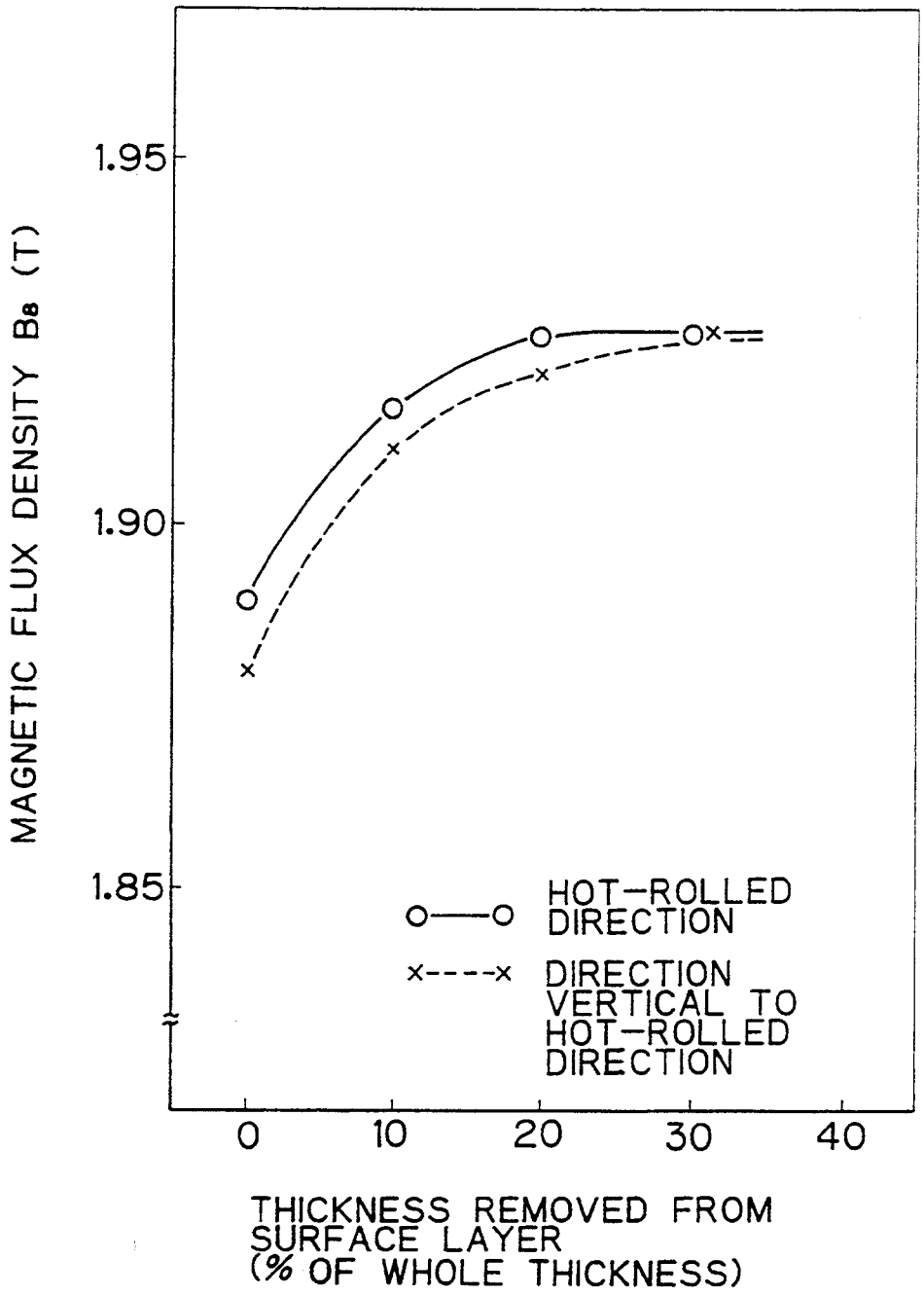
FIG. 7 shows the relationship between the magnetic flux density ($B_8$) of a product and the thickness of the removed layer.

In FIG. 7, the relationship between the amount of material removed from both surfaces of the hot-rolled sheet and the magnetic flux density ($B_8$) value of the product is given. It can be seen from the results that a double oriented electrical steel sheet having a high magnetic flux density can successfully be obtained, when material of more than 1/10, preferably 1/5, of the total thickness is removed from both surfaces. When the material is removed from the both surfaces to a thickness of approximately ⅓ the total thickness, the magnetic property is saturated.

(4) By using work rolls having a diameter of more than a specific value for cold-rolling, the state of the metal flow at the surfaces of a hot-rolled sheet can be varied to suppress the growth of {110} <uvw> grains from the surface in the secondary recrystallization, thereby ensuring the stable manufacture of a double oriented electrical steel sheet having a high magnetic flux density.

The experimental results obtained will be described. A slab containing the same components as described previously was hot-rolled and cold cross-rolled under the same conditions as described above to obtain a cold-rolled sheet having a final thickness of 0.35 mm. Five different work rolls having a diameter of 60 mm, 100 mm, 150 mm, 270 mm, or 490 mm were used in the cold-rolling. The sheets thus cold-rolled were annealed for 210 seconds in a wet hydrogen for both decarburization and primary recrystallization. Thereafter, the sheets were finally annealed after applying an annealing separator containing MgO as a main ingredient.

Figure 8:
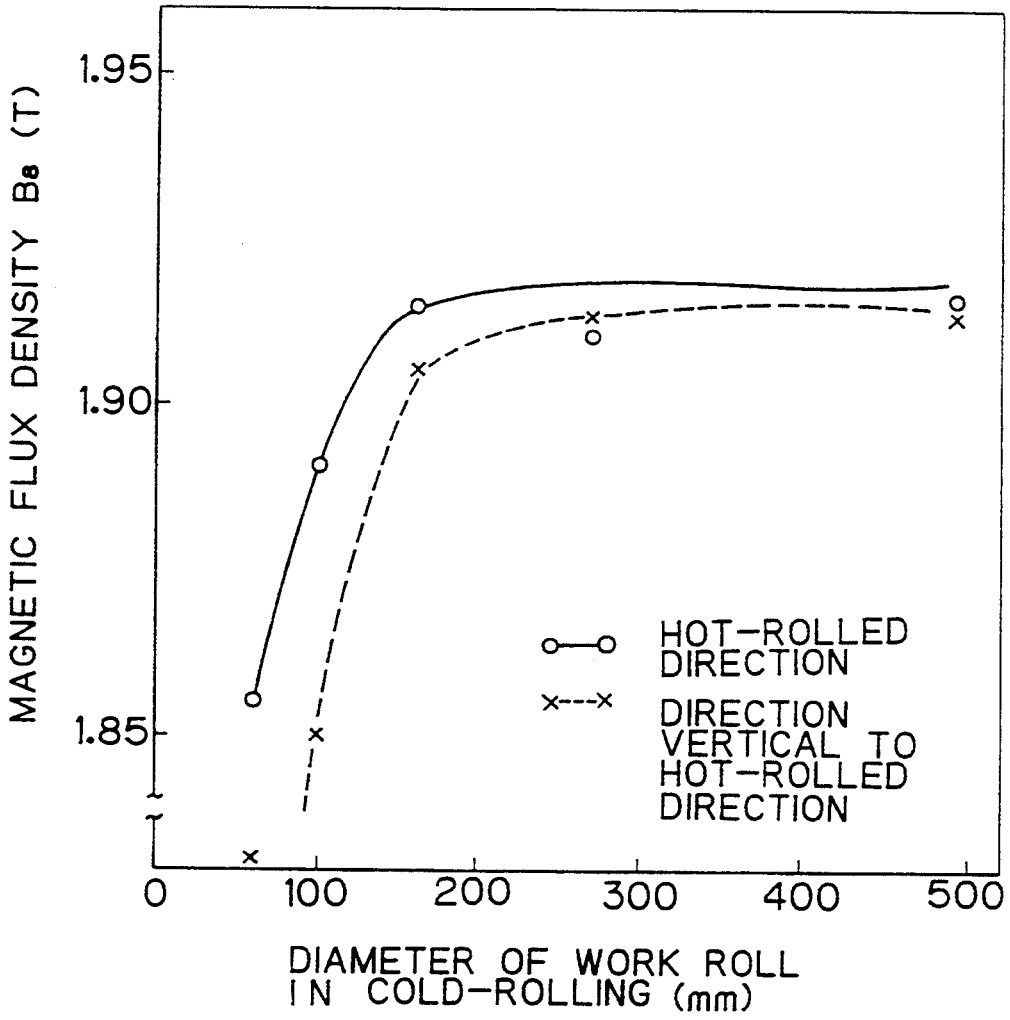
FIG. 8 shows the relationship between the magnetic flux density ($B_8$) of a product and the diameter of a work roll in the cold-rolling.

FIG. 8 shows the relationship between the diameter of work roll used and the magnetic flux density ($B_8$) of a product. It can been seen from FIG. 8 that a product having a high magnetic flux density value of more than 1.90 Tesla, when the diameter of the work rolls in the cold-rolling was more than 150 mm. This effect becomes saturated at a diameter of more than 270 mm.

Figure 9A:
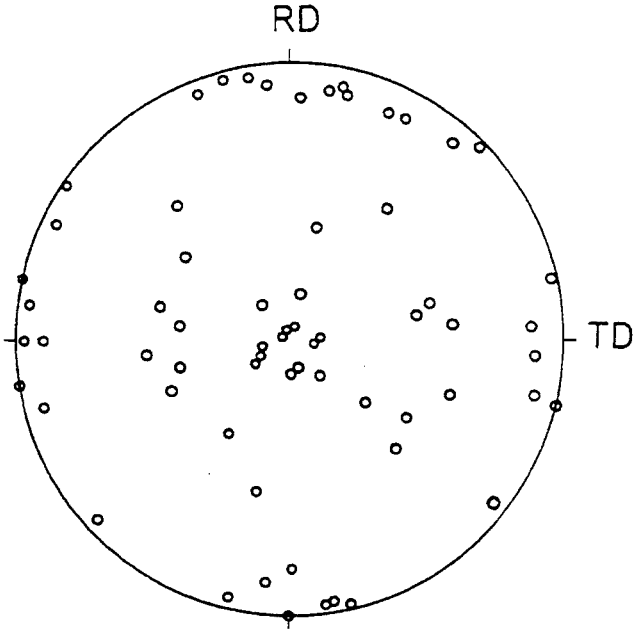
FIGS. 9(*a*) and 9(*b*) show (200) pole figures representing the distribution of grain orientation in the secondary recrystallization in the case where a work roll diameter in cold-rolling is 50 mm (a) and 400 mm (b).
Figure 9B:
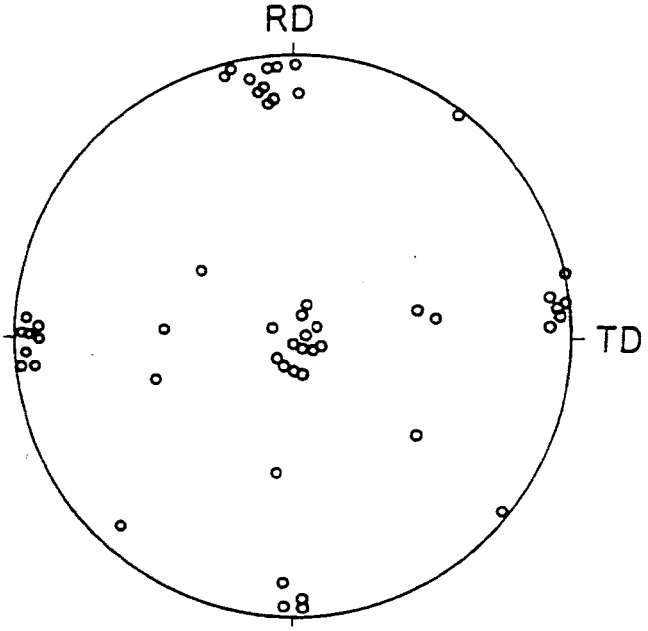

FIG. 9 shows the distribution of crystal grain orientations of the products in the secondary recrystallization where the work roll diameter in the cold-rolling is 60 mm (a) or 490 mm (b). From both pole figures, it can be seen that the growth of {110} <uvw> oriented grains can be successfully suppressed by an increased diameter of the work rolls. The reasons for this are probably as follows:

The work roll diameter in the cold-rolling exerts a significant influence on the metal flow in the thickness direction, and the rotation of crystals in the vicinity of the surface promotes an increased growth of {110} <uvw> oriented grains in the recrystallization as the diameter of the work rolls becomes larger.

Other limited conditions or elements will be described.

A molten sheet used in the present invention may be prepared in any manner, such as in a revolving furnace or electric furnace, and must contain the following components in the following contents:

A high content of Si improves iron loss properties, but decreases the magnetic flux density inevitably. Watt loss is minimum at an Si content of approximately 6.5%, while no improvement can be obtained with the further increase of the content. The upper limit of Si content should, therefore, be specified to be 6.7%. An increased content of Si makes the product brittle, and cold cracks appear at an Si content of more than 4.5%, but worm-rolling can be principally applied to solve this problem. On the other hand, a lower content of Si provides an increased transformation of $\alpha$ into $\gamma$, thereby deteriorating the crystal orientation. The lower limit of the Si content should be determined at 0.8%, which has no substantial influence.

Acid soluble Al forms a nitride such as AlN, (Al,-Si)N, which acts as an inhibitor. The Al content is restricted to be 0.008–0.048%, preferably 0.018–0.036%, where the magnetic flux density of the product increases.

If the content of N exceeds 0.010%, gaps called blisters appear, and thus the upper limit is defined as 0.010%. For the lower limit, the content of N can be adjusted via nitriding in intermediate process steps, and thus it need not be specified.

Furthermore, inhibitor constitution elements such as Mn, S, Se, B, Bl, Nb, Sn, Ti, and Cr may be added.

The molten steel comprised of the above-mentioned components can be used in the present invention as a hot-rolled sheet in the usual manner or to produce a thin cast strip in a continuous casting manner. The hot-rolled sheet or cast strip is cold-rolled directly or after a short time annealing.

This annealing is usually carried out at 750°–1200° C. for 30 seconds to 30 minutes, and effectively enhances the magnetic flux density of products. Therefore, this annealing should be adopted in accordance with the desired level of the magnetic flux density.

The successive reduction rates in the cold-rolling can be selected in the same manner as disclosed in Japanese Examined Patent Publication No. 35-2675 or Japanese Examined Patent Publication No. 38-8213.

The material after being cold-rolled is annealed for the primary recrystallization at a temperature of 750°–1000° C. for a short time of 30 seconds to 10 minutes. Usually, this annealing serves for decarburization of the steel under a controlled dew point in the atmosphere.

Thereafter, the sheet is applied with an annealing separator containing MgO as a main component and for annealing finishing. This finishing annealing effects the secondary recrystallization and purification.

In particular, it is desirable to carry out the secondary recrystallization and the purification separately under specific conditions. In this case, the sheet is controlled to be secondarily recrystallized at a temperature of 950°–1100° C., and then heated to a temperature of more than 1100° C. for purification.

Example (1) A slab containing 0.05% by weight of C, 3.2% by weight of Si, 0.1% by weight of Mn, 0.03% by weight of acid soluble Al, 0.008% by weight of N was heated to 1150° C., and reduced into a 25 mm thickness by coarse rolling, and subsequently, was rolled for finishing into a 1.8 mm thick sheet. A lubricant was applied at the time of the finishing rolling, to reduce friction coefficient. Thereafter, the sheet was annealed at 1100° C. for 2 minutes, was cold-rolled at a reduction rate of 55% in the same direction as the hot-rolled direction, and then cold cross-rolled in the direction vertical to the above-mentioned cold-rolled direction at a reduction rate of 50%. After the annealing for the primary crystallization, which also served for the decarburization, was carried out at 800° C. for 210 seconds in a wet hydrogen atmosphere, an annealing separator was applied, and then annealed for finishing. The finishing annealing was carried out by heating to 1200 ° C. at a heating rate of 15° C./hr in an atmosphere of 50% $N_2$+50% $H_2$, and then annealed with the atmosphere being changed to 100% $H_2$. The properties of the resulting products are as follows.

TABLE 1

| Lubricating Properties | Friction Coefficient at hot-rolling | Magnetic Flux Density ($B_8$: Tesla) Hot-rolled Direction | Direction vertical thereto |
|---|---|---|---|
| No | 0.30 | 1.84 | 1.79 |
| Yes | 0.15 | 1.92 | 1.91 |

(2) A slab having a 26 mm thickness and containing 0.05% by weight of C, 3.2% by weight of Si, 0.1% by weight of Mn, 0.03% by weight of acid soluble Al, and 0.08% by weight of N was heated to 1150° C., and then hot-rolled into a thickness on the following order:

(1) 26→20→18→15→8→4→2 (mm) or (2) 26→15→7→3.5→3→2.5→2 (mm)

to prepare a hot-rolled sheet having a 2.0 mm thickness. After the completion of hot-rolling, the sheet was air-cooled for 1 second, cooled to 550° C. in water, maintained at this temperature for 1 hour, and then cooled by the furnace. The hot-rolled sheet was annealed at 1120 C° for 2 minutes, cold-rolled in the hot-rolled direction at a reduction rate of 50%, and then cold cross-rolled in the direction vertical to the above-mentioned cold-rolled direction at a reduction rate of 50%. An annealing for the primary crystal, which also served as decarburization, was carried out at 800° C. for 210 minutes, an annealing separating agent was applied, and then a finishing annealing for the purpose of the secondary recrystallization and purification was carried out. The magnetic properties of the resulting products are shown in Table 2.

TABLE 2

| Hot-Rolling Conditions | Accumulated reduction rate in the last 3 passes (%) | Magnetic Flux Density ($B_8$: Tesla) Hot-rolled Direction | Direction vatical thereto | Remarks |
|---|---|---|---|---|
| (1) | 87 | 1.83 | 1.75 | Comp. Ex. |
| (2) | 73 | 1.91 | 1.90 | Ex. |

(3) The same slab as in Example 2 was hot-rolled at the initial hot rolling temperature of (1) 1100° C., (2) 1000° C., or (3) 900° C. via the following six passes, i.e., 26→15→6→3.2→2.8→2.4→2 (mm) to prepare a sheet having a 2 mm thickness. The sheet was then annealed for finishing under the same conditions as in Example 2. The magnetic properties of the resulting products are shown in Table 3.

TABLE 3

| Hot-rolling Initiation Temp. (°C.) | Hot-rolling complete Temp. (°C.) | Magnetic Flux Density ($B_8$: Tesla) Hot-rolled Direction | Direction vertical thereto |
|---|---|---|---|
| 1100 | 1000 | 1.92 | 1.92 |
| 1000 | 910 | 1.91 | 1.90 |
| 900 | 830 | 1.90 | 1.90 |

(4) Two samples, i.e. a hot rolled steel sheets containing 0.048% by weight of C, 3.40% by weight of Si, 0.14% by weight of Mn, 0.023% by weight of acid soluble Al, and the balance being Fe and unavoidable impurities having a 1.8 mm thickness in which both surfaces had been ground down to ¼ of the total thickness, by a grinder (sample A), and the hot-rolled sheet, which had not been ground (sample B), were prepared. The cold cross-rolling was applied to these samples by cold-rolling in the same direction as the hot- rolled direction at a reduction rate of 55% and then cold-rolled in the direction vertical to the former cold rolled direction at a reduction rate of 55%. These cold rolled sheets were subjected to annealing for the primary crystallization, which also served for decarburization, at 810° C. for 120 minutes. Subsequently, MgO was applied to the sheets as an annealing separator, the sheets were heated to 1025° C. at a heating rate of 15° C./hr, and then were maintained at 1025° C. for 20 hours to complete the secondary recrystallization. Thereafter, the purification and annealing were carried out at 1200° C. for 20 hours in 100% $H_2$ atmosphere. The magnetic properties of these products are as shown in Table 4.

TABLE 4

| Sample No. | Grinding hot-rolled Sheet | Magnetic Flux Density ($B_8$: Telsla) Hot-rolled Direction | Direction vertical thereto |
|---|---|---|---|
| (A) | Yes | 1.88 | 1.87 |
| (B) | No | 1.84 | 1.85 |

(5) Two samples, i.e. the hot rolled steel sheets as in Example 4 in which both surfaces had been ground down to ¼ of the total thickness, by a grinder (sample A), and the hot-rolled sheet, which had not been ground (sample B), were prepared. These samples were annealed at 1070° C. for 2 minutes, followed by the same treatments in the same stages as in Example 4.

The magnetic properties of these products are as shown in Table 5.

TABLE 5

| Sample No. | Grinding hot-rolled sheet | Magnetic Flux Density ($B_8$: Tesla) Hot-rolled Direction | Direction Vertical thereto |
|---|---|---|---|
| (A) | Yes | 1.95 | 1.93 |
| (B) | No | 1.92 | 1.92 |

(6) A molten steel comprising 0.04% by weight of C, 3.0% by weight of Si, 0.1% by weight of Mn, 0.025% by weight of acid soluble Al, and the balance being Fe and unavoidable impurities was coagulated by suddenly cooling to prepare a thin cast strip having a 1.0 mm thickness. The cast strip was annealed at 1050° C. for 2 minutes, then cold rolled at a reduction rate of 50%, and cold cross rolled in the direction vertical to the cold-rolled direction at a reduce rate of 50%. The diameters of the work rolls in this cold-rolling were 50 mm and 270 mm, respectively. These cold rolled sheets were subjected to the annealing for the primary crystallization at 800° C. for 90 second in a wet hydrogen atmosphere to also serve as decarburization. Thereafter, an annealing separator was applied to the sheets, and then a finishing annealing was carried out. In the finishing annealing, the sheets were heated up to 1030° C. at a heating rate of 30° C./hr, maintained at 1030° C. for 20 hours to complete the secondary crystallization, and then maintained at 1200° C. for 20 hours to be purified. The magnetic properties of these products are as shown in Table 6.

TABLE 6

| Work roll Diameter in Cold-Rolling (mm) | Magnetic Flux Density ($B_8$: Tesla) Hot-rolled Direction | Direction vertical thereto | Remarks |
|---|---|---|---|
| 50 | 1.83 | 1.74 | Comp. Ex. |
| 270 | 1.93 | 1.94 | Ex. |

(7) A hot rolled sheet having a 1.6 mm thickness, comprised of 0.05% by weight of C, 3.3% by weight of Si, 0.15% by weight of Mn, 0.027% by weight of acid soluble Al, and the balance being Fe and unavoidable impurities was annealed at 1120° C. for 2 minutes. Subsequently, the sheet was cold-rolled in the rolled direction mentioned above at a reduction rate of 50%, and then cold cross-rolled in the direction vertical to the cold-rolled direction at a reduction rate of 50%. Thereafter, the sheet was annealed at 800° for 210 seconds in a wet hydrogen atmosphere, which also served for decarburization, an annealing separator was applied thereto, and then a finishing annealing was carried out. The schedule of cold rolling was changed by using work roll for the cold-rolling having a deameter of 50 mm or 270 mm. The magnetic properties of these products are as shown in Table 7. From the results, it can be understood that the use of the working rolls having a larger diameter in at least one of two cold rolling steps is most effective.

TABLE 7

| Work roll Diameter in 1st Cold-Rolling (mm) | Work roll Diameter in 2nd Cold-Rolling (mm) | Magnetic Flux Density ($B_8$: Tesla) Hot-rolled Direction | Direction vertical thereto | Remark |
|---|---|---|---|---|
| 50 | 50 | 1.85 | 1.79 | Comp. Ex. |
| 50 | 270 | 1.90 | 1.91 | Ex. |
| 270 | 50 | 1.92 | 1.90 | Ex. |
| 270 | 270 | 1.92 | 1.91 | Ex. |

What is claimed is:

1. A process for manufacturing a double oriented electrical steel sheet having a high flux density, which comprises subjecting a hot rolled sheet comprised of 0.8–6.7% by weight of Si, 0.008–0.048% by weight of acid soluble al, 0.010% by weight or less of N, and the balance being Fe and unavoidable impurities to a cold-rolling at a reduction rate of 40–80%, and then subjecting the resulting sheet to another cold-rolling in the direction vertical to the above cold-rolled direction at a reduction rate of 30–70% in the final thickness, followed by the steps of annealing to effect primary recrystallization, applying an annealing separator, and applying a finishing annealing to effect secondary recrystallization and purification of the steel, wherein the growth of the secondary recrystallization of {110}<uvw> oriented grains from the surface of the steel sheet is suppressed by removing, from both surfaces of the hot rolled sheet, at least 1/10 of the whole thickness of the hot rolled sheet in the thickness direction.

2. A process for manufacturing a double oriented electrical steel sheet having a high flux density, which comprises subjecting a hot rolled sheet comprised of 0.8–6.7% by weight of Si, 0.008–0.048% by weight of acid soluble Al, 0.010% by weight or less of N, and the balance being Fe and unavoidable impurities to a cold-rolling at a reduction rate of 40–80%, and then subjecting the resulting sheet to another cold-rolling in the direction vertical to the above cold-rolled direction at a reduction rate of 30–70% in the final thickness, followed by the steps of annealing to effect primary recrystallization, applying an annealing separator, and applying a finishing annealing to effect secondary recrystallization and purification of the steel, wherein the growth of the secondary recrystallization of {110}<uvw> oriented grains from the surface of the steel sheet is suppressed by removing at least 1/10 of the whole thickness of both surfaces of the hot rolled sheet in the thickness direction, and then annealing said hot rolled sheet from which the surface layers are removed at a temperature of 750°–1200° C., for 30 seconds to 30 minutes.

* * * * *